US008074556B2

(12) United States Patent
Bantle et al.

(10) Patent No.: US 8,074,556 B2
(45) Date of Patent: Dec. 13, 2011

(54) LOCKING SYSTEMS FOR USE WITH FIREARMS

(75) Inventors: Wolfgang Bantle, Oberndorf-Hochmössingen (DE); Norbert Fluhr, Oberndorf (DE); Johannes-August Bantle, Bosingen (DE); Hermann Albrecht, Oberndorf (DE); Robert Hirt, Balingen (DE); Ralf Kimmich, Bosingen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 116 days.

(21) Appl. No.: 12/272,531

(22) Filed: Nov. 17, 2008

(65) Prior Publication Data

US 2010/0282064 A1 Nov. 11, 2010

Related U.S. Application Data

(63) Continuation of application No. PCT/EP07/04332, filed on May 15, 2007.

(30) Foreign Application Priority Data

May 17, 2006 (DE) ..... 20 2006 007 925 U

(51) Int. Cl.
*F41A 5/24* (2006.01)

(52) U.S. Cl. ..... 89/179

(58) Field of Classification Search ..... 89/158, 89/191.01, 191.02, 192, 193, 198, 179, 180; 42/16, 69.02

See application file for complete search history.

(56) References Cited

U.S. PATENT DOCUMENTS

| | | | | | |
|---|---|---|---|---|---|
| 1,925,776 | A | * | 9/1933 | Scotti et al. | 89/152 |
| 2,049,776 | A | * | 8/1936 | Hyde | 89/129.01 |
| 2,562,801 | A | * | 7/1951 | Maillard | 42/69.02 |
| 3,058,400 | A | * | 10/1962 | Hailston et al. | 89/193 |
| 3,300,888 | A | | 1/1967 | Belcher et al. | |
| 3,553,876 | A | | 1/1971 | Engler | |
| 3,650,177 | A | * | 3/1972 | Hupp et al. | 89/130 |
| 3,990,346 | A | * | 11/1976 | Irwin | 89/180 |
| 4,010,673 | A | * | 3/1977 | Kepplinger et al. | 89/191.02 |
| 4,100,855 | A | | 7/1978 | O'Callaghan | |
| 4,757,627 | A | * | 7/1988 | Saligari | 42/1.12 |
| 4,977,815 | A | * | 12/1990 | Stephens | 89/180 |

(Continued)

FOREIGN PATENT DOCUMENTS

DE 19615181 10/1997

OTHER PUBLICATIONS

International Bureau, "International Preliminary Report on Patentability", issued in connection with counterpart PCT application Serial No. PCT/EP2007/004332, mailed Jan. 22, 2009 (6 pages).

International Searching Authority, Written Opinion for PCT/EP2007/004332, Aug. 26, 2008, 8 pages.

International Searching Authority, International Preliminary Report for PCT/EP2007/004332, Aug. 26, 2008, 15 pages.

(Continued)

*Primary Examiner* — Bret Hayes

(74) *Attorney, Agent, or Firm* — Hanley, Flight and Zimmerman, LLC

(57) ABSTRACT

Locking systems for use with firearms are described. An example locking system for use with a firearm includes a breechblock carrier and a lock spring mechanism that includes a piston. The breechblock carrier is configured to interaction with the piston. Additionally, the example locking system includes a first aperture. The piston is configured to expel fluid through the first aperture when the breechblock carrier retracts.

28 Claims, 5 Drawing Sheets

U.S. PATENT DOCUMENTS

| | | | | |
|---|---|---|---|---|
| 5,886,281 | A * | 3/1999 | Kirstein | 89/185 |
| 5,966,858 | A | 10/1999 | Curtis et al. | |
| 6,668,478 | B2 * | 12/2003 | Bergstrom | 42/1.06 |
| 2002/0178901 | A1 * | 12/2002 | Bergstrom | 89/198 |

OTHER PUBLICATIONS

International Searching Authority, International Search Report for PCT/EP2007/004332, Sep. 18, 2007, 4 pages.

* cited by examiner

LOCKING SYSTEMS FOR USE WITH FIREARMS

RELATED APPLICATION

This patent is a continuation of International Patent Application Serial No.—PCT/EP2007/004332, filed May 15, 2007, which claims priority to German Patent Application 20 2006 007 925.4, filed on May 17, 2006, both of which are hereby incorporated herein by reference in their entireties.

FIELD OF THE DISCLOSURE

This patent relates generally to locking systems and, more specifically, to locking systems for use with firearms.

BACKGROUND

Firearms, such as automatic weapons, have locking systems that include a locking mechanism that advantageously enables the firearm to be locked while a round is being fired and thereafter to be unlocked to facilitate a loading process. Specifically, during the loading process, the locking system utilizes a loading mechanism to reload the firearm to enable the firearm to be refired.

Different known locking systems are available that have different loading mechanisms such as, for example, gas pressure loaders or recoil-operated firearms. Typically, these known loading mechanisms enable the firearm (e.g., an automatic firearm or a semi-automatic firearm) to be automatically loaded or reloaded. However, some known loading mechanisms, may be manually loaded or reloaded. Additionally, some known loading mechanisms may be provided with a feature that enables a marksman to manually load or reload a semi-automatic or automatic firearm or that enables the marksman to manually open or close the locking mechanism of a semi-automatic or automatic firearm.

Generally, firearms provided with a gas pressure loader are self-loading firearms having a locking mechanism with a secured lock. Specifically, after a shot is fired through these firearms, a portion of the propellant gas is rerouted through a pipe to release and open the lock of the locking mechanism to initiate the reloading process.

In operation, the lock of a gas pressure loader is not deactivated until a bullet has passed a designated point in the barrel. The amount of propellant gas rerouted to the loading mechanism may be controlled by a valve to change a cadence of the firearm or to enable different types of munitions or munition assemblies to be utilized.

In some examples, the portion of the gas propellant is directed through a gas discharge and toward a gas piston. The gas propellant acts against the gas piston, which is operatively coupled to a gas rod. A force is transferred via the gas piston and the gas rod to a lock of the locking mechanism. In operation, the gas rod transfers the force to a breechblock carrier of the firearm such as, for example, the breechblock carrier of the G 36 assault rifle. In some known examples, the gas piston, the gas rod and the breechblock carrier are individual components. However, in other known examples, the gas piston, the gas rod and the breechblock carrier are operatively coupled together. Gas pressure loaders may be classified into long stroke systems and short stroke systems. During loading of a firearm provided with a long stroke system, the gas piston moves approximately the same distance as the breechblock carrier. In contrast, during loading of a firearm provided with a short stroke system, the gas piston moves a relatively less distance than the breechblock carrier.

In other gas pressure loading systems, instead of directing the gas propellant toward a gas piston, the gas propellant is directed through the gas discharge to a gas pipe. In these gas pressure loading systems, the gas propellant is directed to the interior of the firearm. Specifically, the gas pipe directs the gas propellant to the lock of the locking mechanism. In operation, a force of the gas propellant impacts the breechblock carrier to facilitate reloading of known firearms such as, for example, the M16 rifle or the M4 carbine.

The overall weight of firearms that are not provided with a gas piston and gas rod is considerably less than the weight of a firearm provided with a gas piston and a gas rod. However, directing the gas propellant in the interior of the firearm often results in residue build up (e.g., residual gas or powder residue) that may cause the firearm to malfunction unless the firearm is frequently cleaned. As a result, the reliability of the M16 rifle was achieved only after significant development and improvement of propellants used with cartridges.

In contrast to firearms provided with gas pressure loading systems, most recoil-operated firearms have a non-secured locking system. In non-secured locking systems, the recoil energy from firing a round is directly utilized to load and reload the firearm. Specifically, in firearms having an unsecured blowback system or a semi-rigid roller lock, the recoil energy impacts a front side of the breechblock, which moves the breechblock toward the rear of the firearm to enable the empty cartridge casing to be ejected from the firearm and for the firearm to be reloaded. Some firearms that are provided with a non-secured locking system are the HK G3 automatic rifle, the Israeli Uzi submachine gun or the MP40 submachine gun of the German Armed Forces.

Known firearms, including firearms provided with gas pressure loading systems, recoil-operated firearms and/or manual repeating systems, are substantially inoperable and/or unreliable after they have been submerged and/or partially submerged in fluid. This may occur during training and/or operations in which the firearm is submerged in a body of water (e.g., a river, a lake, an ocean, etc.) and/or if the firearm is immersed and/or left standing in a fluid. Generally, the fluid (e.g., water) penetrates the interior of the firearm and particularly the firearm's locking system. Specifically, the gas pipe of firearms having a gas pressure loading system (e.g., firearms without a gas piston), such as the M16 rifle or the M4 carbine, fill with fluid, which then typically mandates the firearm to be disassembled and cleaned to restore operability and reliability.

In operation, if fluid penetrates the interior of the firearm such as, the locking system, the fluid may prevent a cartridge from being fired. Specifically, the fluid may decelerate movable components of the firearm utilized during firing such as, for example, a firing pin, to such an extent that the impact of the firing pin on a firing cap is insufficient to fire the round. Problems associated with fluid penetrating the interior of firearms has been generally discussed in U.S. Pat. No. 4,100,855, U.S. Pat. No. 3,300,888, and U.S. Pat. No. 3,553,876.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The example apparatus described herein relates generally to locking systems for use with firearms, which eliminate the limitations encountered with known locking systems. In particular, the example apparatus described herein relates to a locking system that includes at least one chamber, cavity, or bore and at least one fluid access opening or aperture that advantageously enables fluid to drain from the interior of the firearm. The fluid access opening increases the reliability and operability of the firearm, even after the firearm has been submerged or partially submerged in a fluid.

The examples described herein can be implemented on any suitable firearm and/or weapon such as, gas pressure loaders, recoil-operated weapons, manually operated weapons having repeating firing systems or weapons having any other type of locking or loading system. Some firearms and/or weapons in which the examples described herein can be implemented are, for example, handguns, weapons mounted on a gun carriage, automatic firearms, semi-automatic firearms, small caliber firearms, large caliber firearms, assault rifles, machine guns, submachine guns, weapons having repeating firing systems and/or automatic cannons or grenade launchers.

Figure 1:
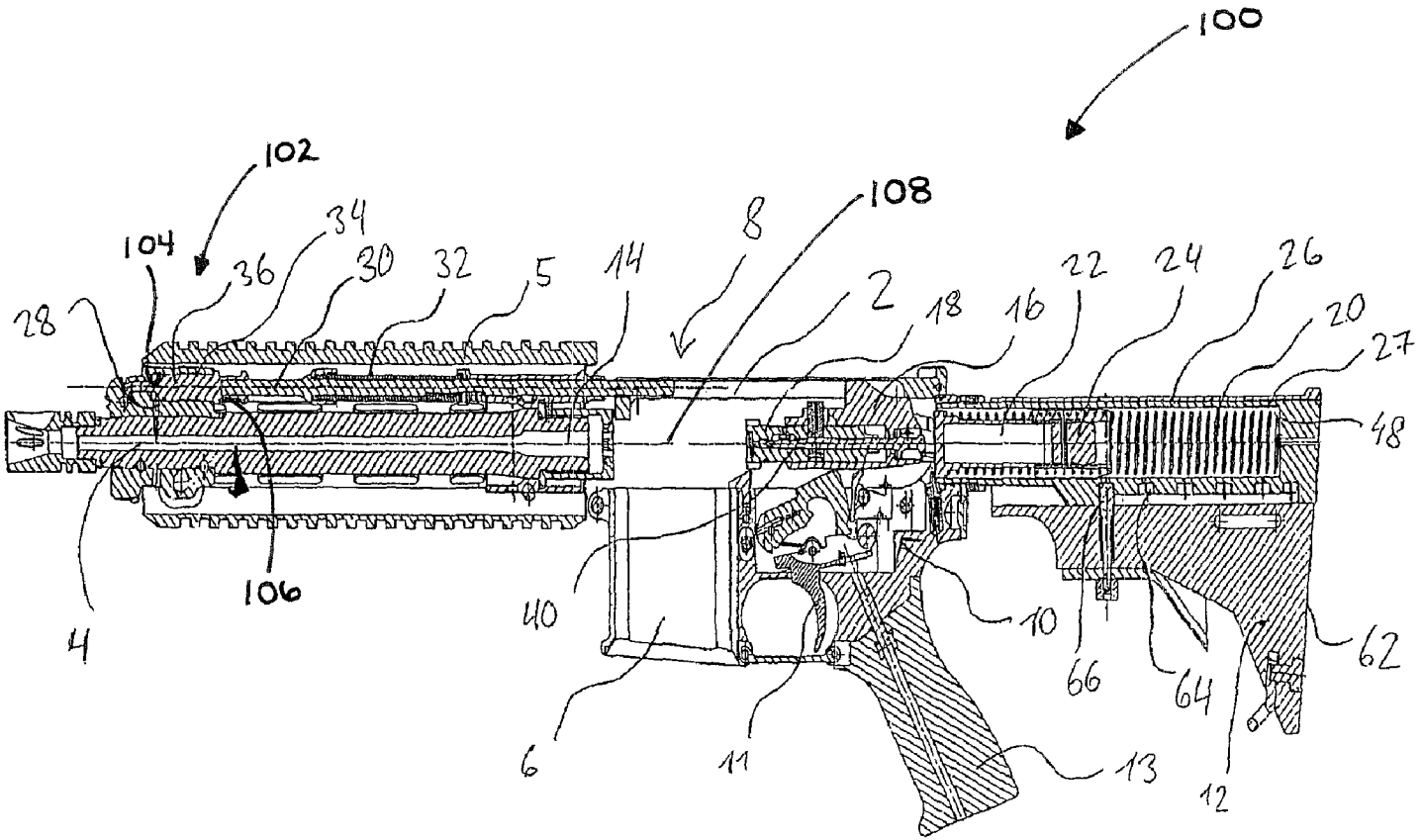
FIG. 1 depicts an example firearm that includes an example locking system.

FIG. 1 depicts an example firearm 100 (e.g., an assault rifle) that includes a housing 2, a pipe or barrel 4, a hand guard 5, a magazine shaft or magazine receiver 6, a locking system 8, a trigger mechanism 10, a trigger 11, a stock 12 and a handle 13. A cartridge chamber 14 is defined toward the rear of the barrel 4. A breechblock carrier 16 (e.g., a lock) and a breechblock 18 (e.g., a lock) are movably positioned adjacent the cartridge chamber 14 to lock a cartridge in the cartridge chamber 14 during firing. In operation, the breechblock 18 is movable relative to the breechblock carrier 16 and/or the housing 2 to facilitate loading and unloading of the firearm 100.

Toward the rear of the firearm 100, a second chamber or hollow space 48 is defined in which a spring mechanism is positioned. The spring mechanism includes a spring 20 (e.g., a lock spring), a piston 22 (e.g., a lock spring piston), a piston buffer 24 (e.g., a lock spring piston buffer) and a guide tube 27 (e.g., a lock spring guide tube). The spring mechanism is advantageously utilized to exert a force on the breechblock carrier 16 to close a breech. The spring 20 is at least partially positioned in the guide tube 27 and a spring housing 26 (e.g., a lock spring housing). Additionally, the piston 22 is at least partially positioned and movable within the guide tube 27. The piston buffer 24 is positioned between the piston 22 and the spring 20 to buffer movement and/or an impact of the piston 22 against the guide tube 27. A plurality of notches 64 (e.g., notch openings) are defined to enable a marksman to horizontally adjust a shoulder support 62 and/or the stock 12 to custom fit the firearm 100 to the particular marksman. A pin 66 is positioned and/or inserted in one of the plurality of notches 64 to secure and/or couple the shoulder support 62 and/or the stock 12 relative to the housing 2 in a particular position.

A description relating to certain components of the firearm 100 such as, for examples, the trigger mechanism 10, are generally known. As such, a description of these components will not be provided here. A general description of a firearm having a gas pressure loading system is described in DE 196 15 181.

A gas pressure loader 102 includes a gas cylinder 34 that defines a gas chamber or bore 104, which is fluidly coupled to the barrel 4 via a gas discharge 28. A gas piston 36 is operatively coupled to a gas rod 30 at an end 106 of the gas piston 36. Additionally, the gas piston 36 is positioned and slidingly engages a surface of the gas cylinder 34. In operation, an interaction between the gas rod 30 and the breechblock carrier 16 and the breechblock 18 move the breechblock carrier 16 and the breechblock 18 toward the rear of the firearm 100 to open the breech. Additionally, as the gas rod 30 moves toward the rear of the firearm 100, a radial cam (not shown) and a control bolt (not shown) release locking pegs (e.g., locking nipples) to unlock the breechblock 18 from behind the cartridge chamber 14. In operation, a force exerted by the gas rod 30 moves both the breechblock carrier 16 and the breechblock 18 toward the rear of the firearm 100 against a spring force of the spring 20. Additionally, the gas rod 30 is preloaded via a gas rod spring 32 to move the gas rod 30 toward the front of the firearm 100 (e.g., the starting position).

FIG. 1 depicts the firearm 100 in a firing position in which the breechblock carrier 16 and the breechblock 18 are in an open position and the trigger mechanism 10 is retained behind the magazine receiver 6. In operation, during firing, the breechblock carrier 16 and the breechblock 18 move a cartridge (not shown) from a magazine (not shown) toward the front of the firearm 100 and position the cartridge in the cartridge chamber 14. Additionally, to secure the cartridge in the cartridge chamber 14, the breechblock carrier 16 and the breechblock 18 are locked relative to the housing 2 via, for example, locking pegs. To ignite the cartridge, the firearm 100 includes a firing pin 40 having a hammer 46 that is movable relative to an axis 108 in a first chamber 38 (e.g., a functional hollow space or firing pin channel) and is at least partially positioned in the breechblock 18. The firing pin 40 is preloaded via a firing pin spring 42 (e.g., a spring) and is at least partially surrounded by a firing pin spring guide, channel, cylinder or housing 44 (e.g., spring guide). To fire a round through the firearm 100, the firing pin 40 is released via the trigger mechanism 10 if the locking system 8 of the firearm 100 is secured. In operation, the trigger mechanism 10 strikes or impacts the hammer 46 to, for example, release the firing pin 40 to impact and ignite a cartridge positioned in the cartridge chamber 14.

The breechblock carrier 16 and the breechblock 18 remain secure and/or locked adjacent the cartridge chamber 14 until the bullet (not shown) has discharged and/or been released from the barrel 4 and a gas pressure behind the bullet is rerouted through the gas discharge 28 toward the gas piston 36. The gas pressure acts against the gas piston 36 to move the gas piston 36 and the gas rod 30 to unlock the breechblock carrier 16 and the breechblock 18. Additionally, as the breechblock carrier 16 and the breechblock 18 are unlocked, the breechblock carrier 16 moves toward the rear of the firearm 100 and away from the barrel 4 and an extractor (not shown) of the breechblock 18 removes and/or extracts the empty cartridge casing from the cartridge chamber 14. The empty cartridge casing is then ejected from the breechblock carrier 16 and the breechblock 18 via an ejection mechanism (not shown) having an ejector (not shown). The movement of the breechblock carrier 16 and the breechblock 18 toward the rear of the firearm 100 loads and/or compresses the spring 20 and the trigger mechanism 10. The piston buffer 24 buffers and/or controls the travel of the breechblock carrier 16 to prevent, for example, damage to inner surfaces of the shoulder support 62. After the empty cartridge casing is ejected, the breechblock carrier 16 and the breechblock 18 are retained in the open position by the trigger mechanism 10 until, for example, the above described process is repeated.

Figure 2:
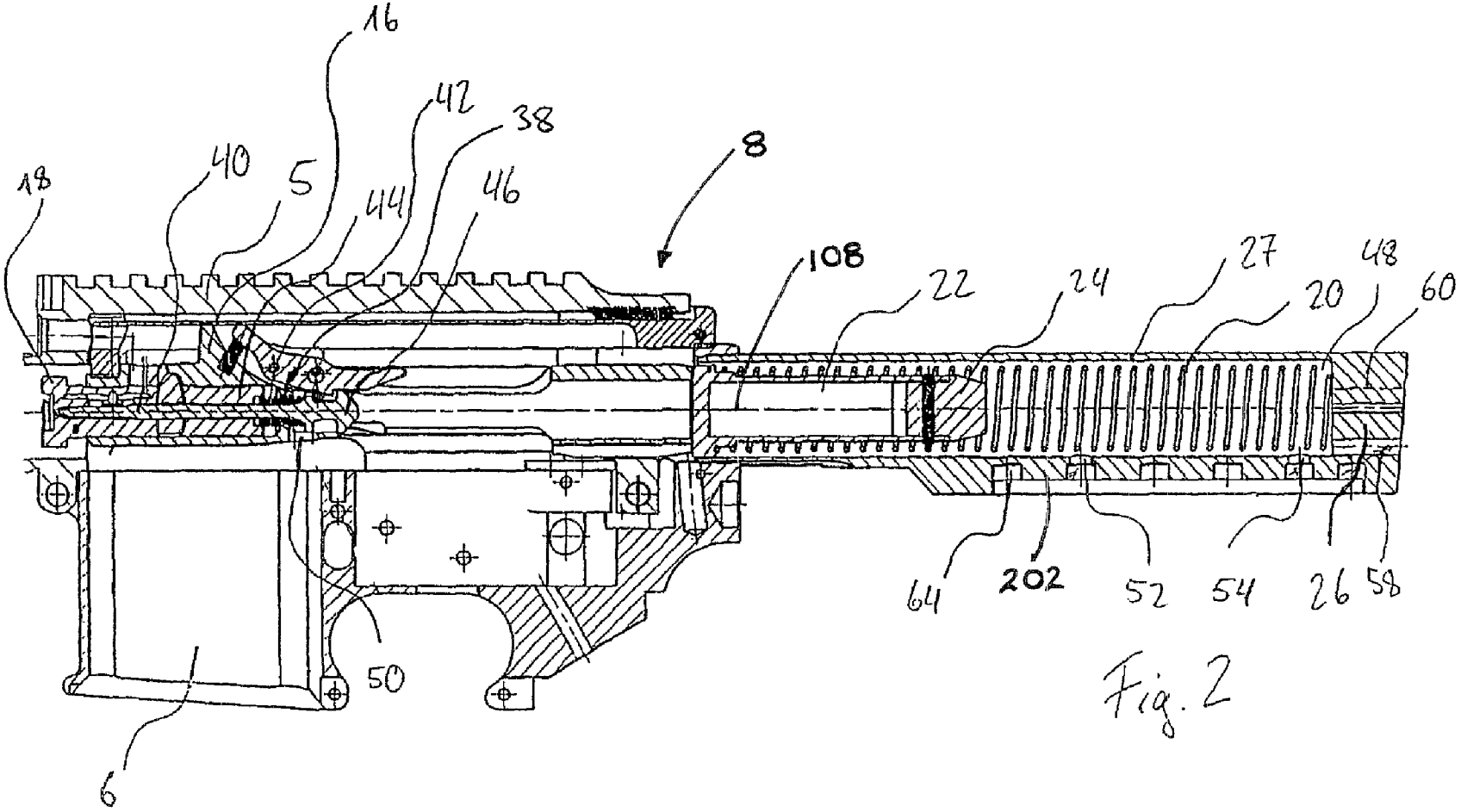
FIG. 2 depicts a portion of the example firearm of FIG. 1.

FIG. 2 depicts a portion of the example firearm 100 of FIG. 1 having the locking system 8. Additionally, FIG. 2 depicts the first chamber 38 and the second chamber 48. To enable fluid to drain from the interior of the firearm 100, the example firearm 100 is provided with a plurality of fluid access openings, apertures or through holes. Specifically, an aperture 50 (e.g., a first fluid access opening or first aperture) fluidly couples the first chamber 38 to the exterior of the firearm 100 (e.g., an outside area). While the example of FIG. 2 includes one aperture that fluidly couples the first chamber 38 to the exterior of the firearm 100, in other examples, any number of apertures (e.g., 1, 2, 3, 4, 5, etc.) may be included instead. Additionally, a plurality of apertures 52, 54, 56, 58 and 60 (e.g., fluid access openings or a second aperture, a third aperture, a fourth aperture, a fifth aperture, and a sixth aperture, respectively) fluidly couple the second chamber 48 to the exterior of the firearm 100 (e.g., an outside area). While the example of FIG. 2 includes five apertures that fluidly couple the second chamber 48 to the exterior of the firearm 100, in other examples, any number of apertures (e.g., 1, 2, 3, 4, 5, etc.) may be included instead. In this example, each of the apertures 52 and 54 are positioned radially and/or substantially perpendicular to the axis 108 from the second chamber 48 to one of the plurality of notches 64. In contrast, each of the apertures 56, 58, and 60 (see FIG. 5) are positioned axially and/or substantially parallel to the axis 108 from the second chamber 48, which includes the lock spring mechanism, into and/or through the shoulder support 62 to the exterior of the firearm 100.

In operation, the plurality of apertures 50, 52, 54, 56, 58 and 60 advantageously enable the firearm 100 to be fired even if fluid has entered the interior of the firearm 100. Specifically, the plurality of apertures 50, 52, 54, 56, 58 and 60 advantageously enable the firing pin 40 to move relatively unimpeded even if fluid has entered the first chamber 38 and/or the second chamber 48. Additionally, the plurality of apertures 50, 52, 54, 56, 58, and 60 advantageously enable fluid to passively drain from the firearm 100 without any additional assistance from a marksman or from a mechanism or apparatus (e.g., specific weapon mechanism). Additionally, the plurality of apertures 50, 52, 54, 56, 58, and 60 advantageously enable fluid to be expelled (e.g., actively eliminated) from the locking system 8 if a round is fired through the firearm 100 and the firearm 100 is loaded and/or reloaded via, for example, the trigger mechanism 10 (e.g., automatic reloading, manual reloading, or repeated reloading). Specifically, fluid exits the firearm 100 toward the bottom of the firearm 100 through the aperture 50 and into the magazine receiver 6 or into a magazine (not shown) positioned in the magazine receiver 6. Additionally, fluid exits toward the bottom of the firearm 100 radially through the apertures 52 and 54. Further, fluid exits toward the rear of the firearm 100 axially into and/or through the shoulder support 62 via the apertures 56, 58, and 60.

Figure 3:
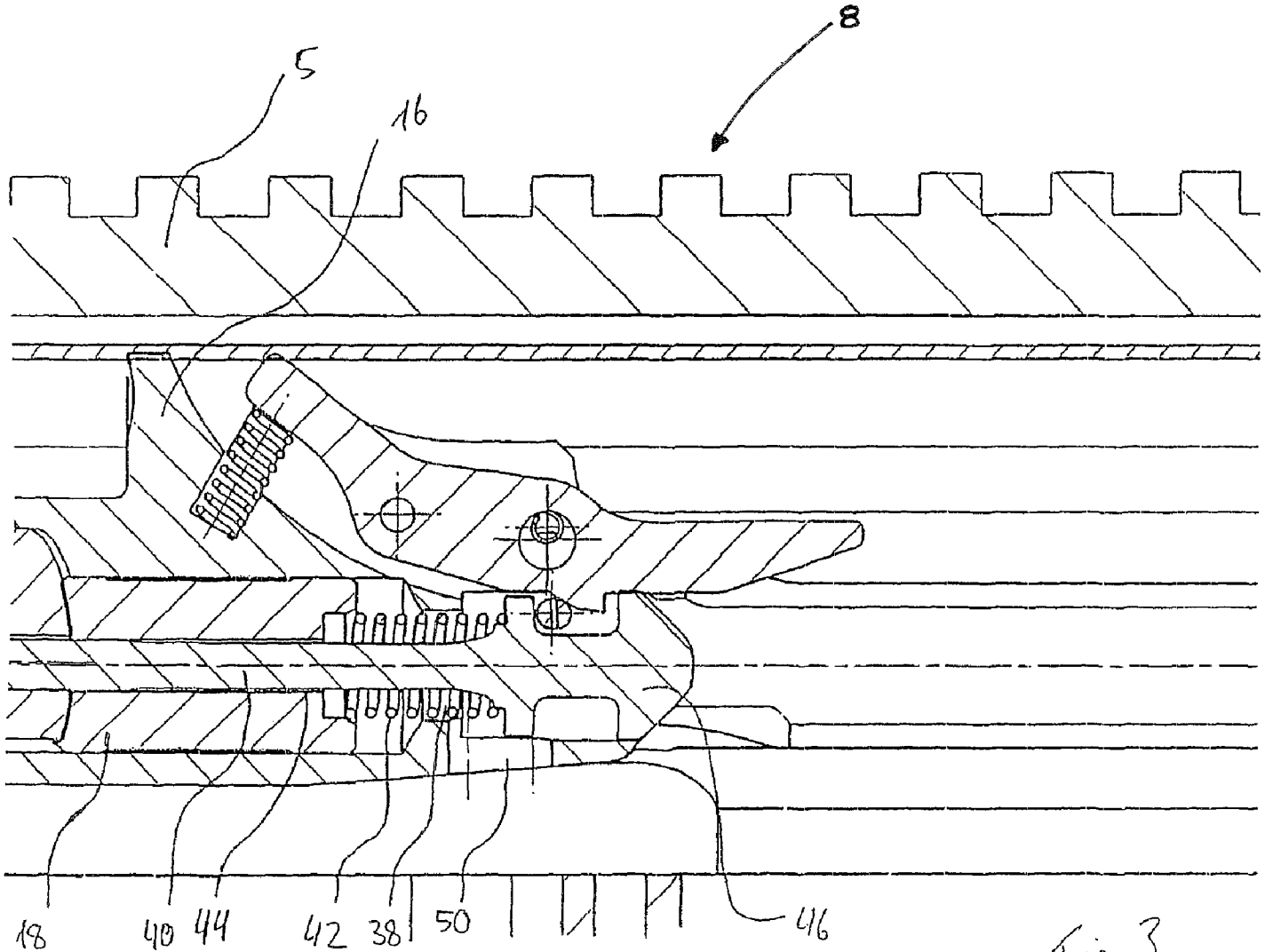
FIG. 3 depicts a front portion of the example locking system of FIG. 1.

FIG. 3 depicts a front portion of the locking system 8 to illustrate the aperture 50 in detail.

Figure 4:
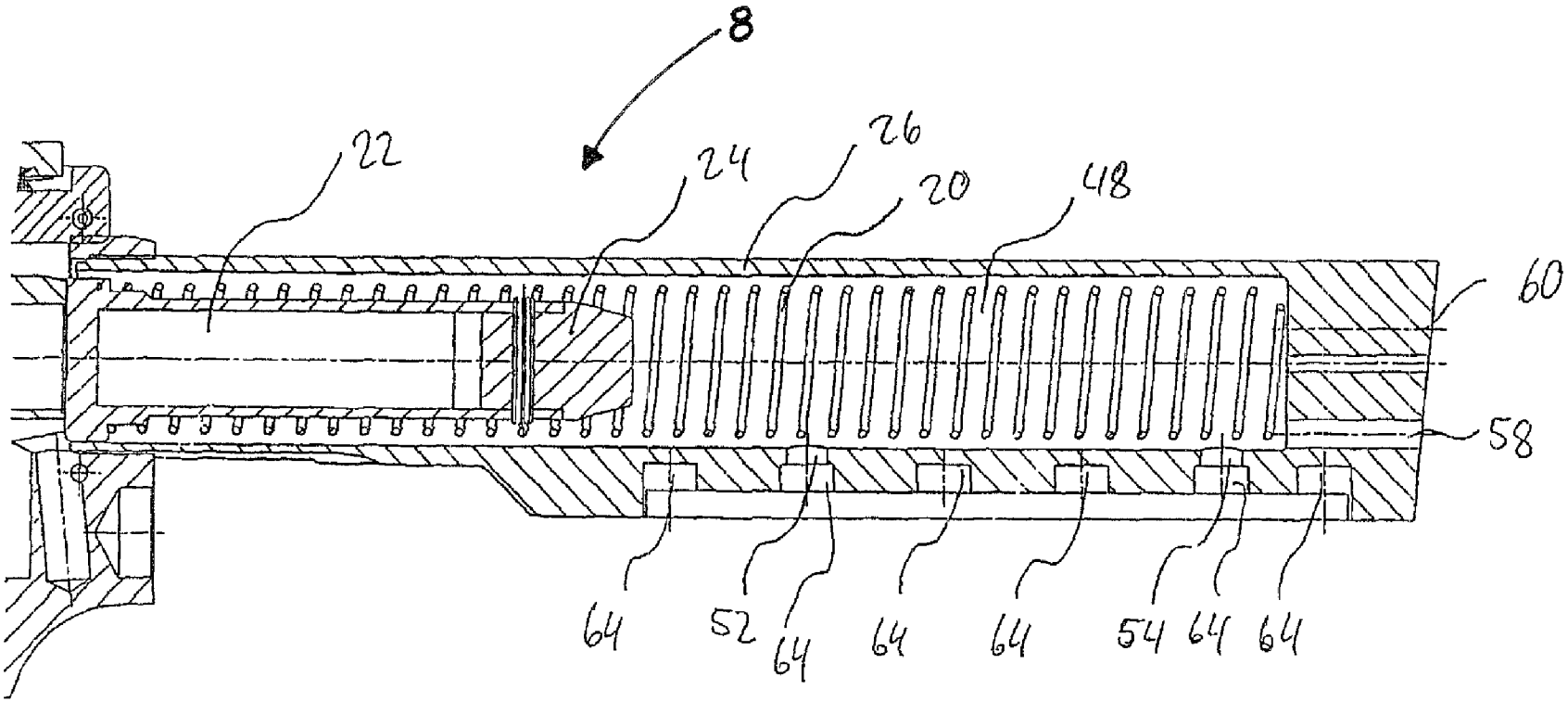
FIG. 4 depicts a rear portion of the example locking system of FIG. 1.

FIG. 4 depicts a rear portion of the locking system 8 to illustrate the apertures 52, 54, 58, and 60, and specifically the apertures 52 and 54 that are radially positioned adjacent one of the notches 64 and the axially positioned apertures 58 and 60.

Figure 5:
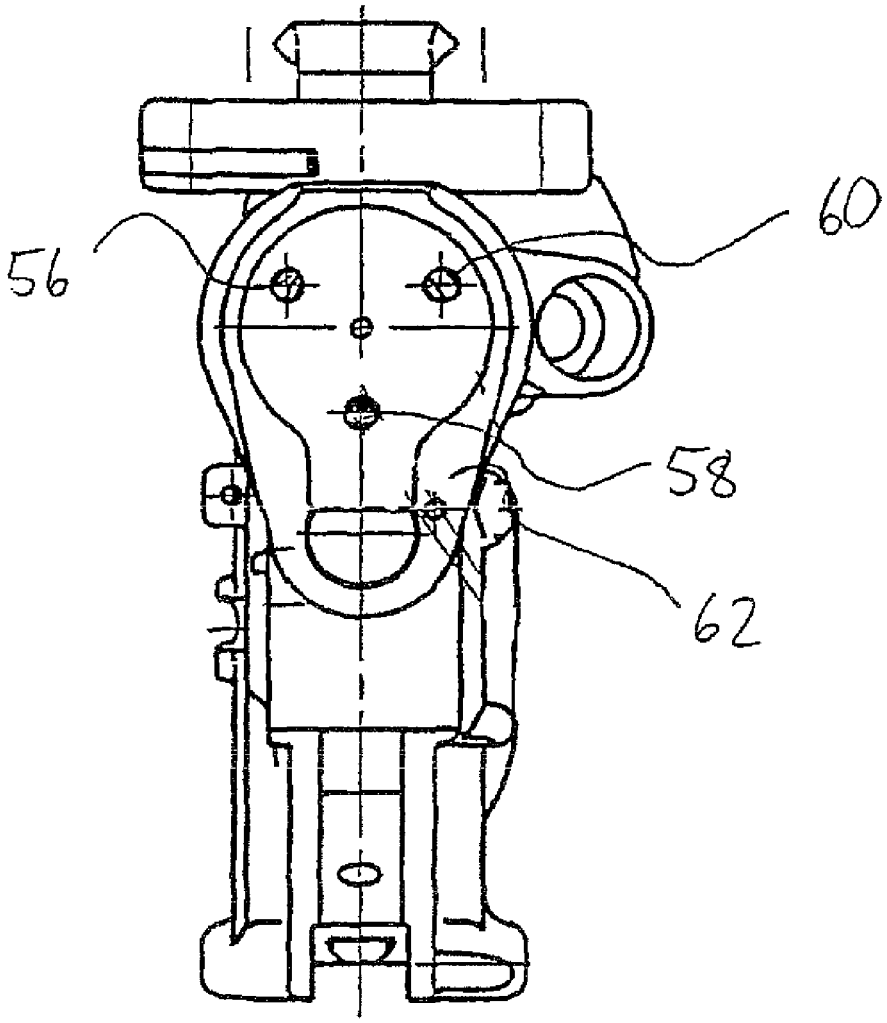
FIG. 5 depicts a rear view of the example firearm of FIG. 1.

FIG. 5 depicts a rear view of the shoulder support 62 of the firearm 100 of FIG. 1. Specifically, FIG. 5 depicts the axially positioned apertures 56, 58, and 60. In operation, fluid positioned in the second chamber 48 is expelled (e.g., eliminated) by the movement of the piston 22 (FIGS. 1 and 2), which moves and/or pushes the fluid though at least one of the apertures 52, 54, 56, 58, or 60. Additionally, in operation, fluid positioned within the second chamber 48 is passively drained through, for example, the axially positioned apertures 56, 58, and 60.

The example apparatus described herein relate to locking systems for use with firearms that substantially eliminate malfunctions encountered by known firearms after being immersed in fluid (e.g., water).

As described above, the breechblock carrier 16 interacts with the piston 22 to expel (e.g., eliminate) fluid through at least one of the apertures 50, 52, 54, 56, 58, and 60. In particular, as the breechblock carrier 16 retracts toward the rear of the firearm 100, the piston 22 also moves toward the rear of the firearm 100, to, for example, increase the pressure in the first chamber 38 and/or the second chamber 48 to force the fluid through at least one of the apertures 50, 52, 54, 56, 58, and 60 and out of the firearm 100.

As discussed above, the locking system 8 of the firearm 100 includes the breechblock carrier 16 and the apertures 50, 52, 54, 56, 58, and 60 (fluid access openings) that fluidly couple the first chamber 38 and/or the second chamber 48 to the exterior of the firearm 100. In operation, the apertures 50, 52, 54, 56, 58, and 60 advantageously enable fluid that may have penetrated the interior of the firearm 100 to be relatively quickly and easily drained from the firearm 100. As a result, the example apparatus described herein enables firearms provided with the example locking system 8 to be more reliable and operable in situations in which the reliability and operability of known firearms would be questionable. Specifically, movable components of the firearm 100 and/or the locking system 8 are substantially unaffected by fluid penetrating the interior of the firearm 100.

Prior to the examples described herein, it would have been unheard of to fire a firearm after being immersed in a fluid. However, some soldiers (e.g., marksman) such as, for example, combat divers, combat swimmers, members of landing forces, and/or members of special units or operations, involved in particular operations and/or training exercises frequently encounter situations in which they and/or their firearm are exposed to water. In such situations, the examples described herein advantageously enable the marksman to fire the firearm 100, which is provided with the example locking system 8, substantially immediately after the firearm 100 has emerged from the fluid.

As discussed above, at least one of the apertures 50, 52, 54, 56, 58, and 60 enables fluid in either the first chamber 38 and/or the second chamber 48 to be channeled and efficiently drained and/or to remove fluid residue while firing, loading and/or reloading the firearm 100. Additionally, the position and/or interaction between each of the apertures 50, 52, 54, 56, 58, and 60 substantially ensures against and/or reduces interferences associated with fluid penetration in the interior of the firearm 100.

The apertures 50, 52, 54, 56, 58, and 60 may be positioned in any suitable arrangement that enables fluid to be expelled from the firearm 100. Additionally, the apertures 50, 52, 54, 56, 58, and 60 may have any suitable size and/or shape such as, for example, a round shape, an oval shape, an angular shape, a rectangular shape, a triangular shape, etc. Additionally, an object (e.g., a hollow object, a case, or a pipe) (not shown) may be inserted into at least one of the apertures 50, 52, 54, 56, 58, and 60. The object may have any suitable shape and/or size and may be made of any suitable material such as, for example, a metal material, a plastic material, etc. In practice, the object may have an interference fit with the aperture 50, 52, 54, 56, 58, and/or 60. Additionally, the object may be fused, riveted, jammed and/or pressed into the aperture 50, 52, 54, 56, 58, and/or 60. However, in other examples, the object may be removable coupled to the aperture 50, 52, 54, 56, 58, and/or 60. Additionally, the apertures 50, 52, 54, 56, 58, and/or 60 may be formed, extruded, manufactured and/or fabricated in the locking system 8 and/or the firearm 100 in any suitable way such as, for example, drilling or milling a hole, opening, or recess and/or by removing or eliminating a portion(s) of the locking system 8 and/or the firearm 100 during production, extrusion or sometime thereafter.

Preferably, the apertures 50, 52, 54, 56, 58, and 60 are a round drilled hole into which a pipe section (not shown) (e.g., the object) is inserted. This enables the examples described herein to be cost efficiently produced and to enable fluid to relatively quickly discharge from the interior of the firearm 100.

As described above, the firearm 100 includes the breechblock carrier 16, the breechblock 18 and the spring mechanism. Additionally, the firearm 100 includes two functional chambers and/or cavities, which include the first chamber 38 and the second chamber 48. However, in other examples, the firearm 100, may have any other number of functional chambers and/or cavities (e.g., 1, 2, 3, 4, 5, etc.).

In some examples, the lock is integrally formed on the firearm 100. However, preferably, the lock includes the breechblock carrier 16 and the breechblock 18. Additionally, the first chamber 38 is defined and/or at least partially positioned in the breechblock carrier 16. In practice, the firing pin 40, the firing pin spring 42 and/or the firing pin spring guide 44 are included in and/or positioned in the first chamber 38.

As discussed above, the locking system 8 includes the plurality of apertures 50, 52, 54, 56, 58, and 60. However, preferably, at least one of the apertures 50, 52, 54, 56, 58, and 60 is positioned toward the front of the firearm 100 and at least one of the apertures 50, 52, 54, 56, 58, and 60 is positioned toward the rear of the firearm 100. Specifically, the aperture 50 fluidly couples the first chamber 38 to the exterior of the firearm 100 and the apertures 52, 54, 56, 58, and 60 fluidly couple the second chamber 48 to the exterior of the firearm 100.

The aperture 50 may be positioned laterally, at an angle, or radially upwards or downwards relative to the axis 108 of the firearm 100. However, preferably, the aperture 50 extends downward relative to the firearm 100 through a radial hole in the breechblock carrier 16 to adjoin the breechblock carrier 16 to the exterior of the firearm 100. Specifically, the aperture 50 is approximately perpendicular to the axis 108 and below the firing pin 40. The position of the aperture 50 ensures that the firing pin 40 can move relatively unimpeded and remain functional even if fluid has entered the first chamber 38. Specifically, the position of the aperture 50 relative to the firing pin 40 enables fluid to drain quickly through the aperture 50 as the firing pin 40 moves relative to the housing 2 during firing. Additionally, the firing pin 40 can be actuated and/or released independently from the loading mechanism, which ensures that at least one round is able to be fired from the firearm 100 having the example locking system 8.

As described above, the firearm 100 includes the spring housing 26 and the second chamber 48 that is positioned at least partially in the spring housing 26. Additionally, the lock spring mechanism, which includes, the piston 22, the spring 20, the guide tube 27 and the piston buffer 24, is positioned in the second chamber 48.

Preferably, at least one of the apertures 52, 54, 56, 58, and/or 60 is poisoned through a wall 202 of the guide tube 27, the stock 12 and/or the shoulder support 62. As discussed above, the apertures 52, 54, 56, 58, and/or 60 can be positioned laterally, angularly and/or radially upwards and/or downwards relative to the axis 108. However, preferably, to increase fluid channeling, the firearm 100 includes two apertures 52 and 54 that are radially positioned relative to the axis 108 and three apertures 56, 58, and 60 axially positioned relative to the axis 108. Additionally, each of the apertures 52 and 54 is positioned adjacent one of the notches 64, which are utilized to horizontally adjust the shoulder support 62. Preferably, the firearm 100 is provided with at least one aperture 50 positioned adjacent and/or through the breechblock carrier 16 and at least five apertures 52, 54, 56, 58, and 60 positioned adjacent the second chamber 48. The position and/or the number of apertures 50, 52, 54, 56, 58, and 60 substantially ensures that moveable components of the firearm 100, such as, the firing pin 40, the breechblock carrier 16, and/or the breechblock 18 (e.g., the lock), which may be positioned in the first chamber 38 and/or the second chamber 48, are operable and/or reliable even if fluid has penetrated the interior of the firearm 100. In operation, the lock may be actuated by manual reloading or automatic reloading (e.g., passive reloading).

Additionally, the first chamber 38 and the second chamber 48 are positioned and/or arranged such that fluid in the interior of the firearm 100 flows toward either of the respective chambers 38 and/or 48. In operation, if fluid is expelled through one of the apertures 50, 52, 54, 56, 58, and/or 60, a gas (e.g., air) can enter another of the apertures 50, 52, 54, 56, 58, and/or 60 to accelerate a discharge of fluid from the interior of the firearm 100 and/or to substantially prevent a pull or force against the firing pin 40 and/or any other interference of the firing pin 40 or the piston 22.

As described above, the locking system 8 includes the spring housing 26 and the second chamber 48 that is positioned in the spring housing 26. The spring housing 26 assists in guiding the spring 20. However, in other examples, the spring housing 26 may be omitted. Additionally, the lock spring mechanism, which includes the piston 22, the spring 20, the guide tube 27 and/or the piston buffer 24, is positioned in the second chamber 48. At least some of the apertures 50, 52, 54, 56, 58, and/or 60 are positioned adjacent or through the wall 202 of the guide tube 27.

As discussed above, the locking system 8 includes the plurality of notches 64 to enable horizontal adjustment of the shoulder support 62. Preferably, each of the apertures 52 and 54 is radially positioned adjacent one of the notches 64 to fluidly couple the second chamber 48 to the respective notch 64. However, in other examples, any number of the notches 64 may have an adjacent aperture (e.g., 1, 2, 3, 4, 5, etc.).

Additionally, at least one of the apertures 50, 52, 54, 56, 58, and/or 60 is arranged and/or designed to substantially ensure that fluid that has penetrated the interior of the firearm 100 is expelled from the firearm 100 between about 1-3 seconds, which enables the firearm 100 to be fired relatively quickly after being submerged in fluid.

While the examples described herein can be implemented on any suitable firearm such as, for example, gas pressure loaders, recoil-operated weapons, manually operated weapons, semi-automatic weapons, or automatic weapons, the examples described herein are preferably implemented in a gas pressure loader (e.g., such as the gas pressure loader 102 of FIG. 1). Specifically, a gas pressure loader having a short stoke gas piston system.

Generally, the gas pressure loader 102 includes the locking system 8, and more specifically, the gas pressure loader 102 includes the gas rod 30, the gas piston 36, and the gas cylinder 34. Preferably, the gas rod 30 extends from the gas discharge 28 to the breechblock carrier 16. Additionally, interaction between the gas rod 30 and the locking system 8 moves the breechblock carrier 16 relative to the housing 2 to facilitate loading, unloading, and reloading of the firearm 100. In operation, as the breechblock carrier 16 moves relative to the housing 2, the piston 22 also moves, which expels fluid from the interior of the firearm 100 through at least one of the apertures 50, 52, 54, 56, 68, and/or 60. In some examples, the gas rod 30 is interconnected and/or integrally coupled to the breechblock carrier 16. However, in other examples, the gas rod 30 is adjacent and/or not interconnected to the breechblock carrier 16.

Additionally, the example firearm 100 is provided with a compression ring (not shown) between, for example, the gas cylinder 34 and the gas piston 36. In operation, the gas cylinder 34 advantageously removes and/or prevents residue (e.g., propellant gas and associated residue) from entering and/or penetrating the interior of the firearm 100. As such, the amount of time required to properly clean the firearm 100 is reduced while also increasing the reliability of the firearm 100.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A locking system for use with a firearm, comprising:

a breechblock;

a breechblock carrier;

a lock spring mechanism including a piston, the breechblock carrier being configured to drive the piston as the breechblock carrier retracts to open a breech; and a first aperture, wherein the piston is configured to expel fluid through the first aperture to an exterior of the firearm when the breechblock carrier retracts.

2. The locking system as defined in claim 1, further comprising a chamber that is fluidly coupled to an exterior of a firearm by the first aperture, wherein when fluid is contained in the chamber, the fluid is to flow from the chamber through the first aperture to the exterior of the firearm.

3. The locking system as defined in claim 2, further comprising a second aperture that is axially positioned relative to an axis of the firearm and wherein the first aperture is radially positioned relative to the axis.

4. The locking system as defined in claim 2, further comprising a second aperture that fluidly couples the chamber to the exterior of the firearm, wherein the first aperture is to enable fluid to flow from the chamber to the exterior of the firearm and the second aperture is to enable air to flow from the exterior of the firearm to the chamber.

5. The locking system as defined in claim 2, wherein the chamber is at least partially defined by a spring housing.

6. The locking system as defined in claim 2, wherein the lock spring mechanism is at least partially positioned in the chamber.

7. The locking system a defined in claim 1, wherein the lock spring mechanism comprises the piston, a spring, a guide tube, and a piston buffer.

8. The locking system as defined in claim 7, wherein the first aperture is at least partially defined by the guide tube.

9. The locking system as defined in claim 1, wherein the first aperture is at least partially positioned in at least one of a stock or a shoulder support of a firearm.

10. The locking system as defined in claim 1, wherein the first aperture is to enable fluid to flow from a firearm to an exterior of the firearm for between about one to three seconds.

11. The locking system as defined in claim 1, further comprising a second aperture that is at least partially defined by the breechblock carrier, wherein the second aperture is radially positioned relative to an axis of a firearm.

12. The locking system as defined in claim 11, wherein the second aperture is positioned adjacent a firing pin toward a bottom of the firearm.

13. The locking system as defined in claim 11, further comprising a chamber that is fluidly coupled to an exterior of the firearm by the second aperture, wherein when fluid is contained in the chamber, the fluid is to flow from the chamber through the second aperture to an exterior of the firearm.

14. The locking system as defined in claim 13, wherein the chamber is a firing pin channel.

15. The locking system as defined in claim 14, wherein at least one of a firing pin, a spring, or a spring guide is at least partially positioned in the firing pin channel.

16. The locking system as defined in claim 13, wherein the chamber is a first chamber.

17. The locking system as defined in claim 16, further comprising a second chamber, wherein the first aperture is to enable fluid to flow from the second chamber to the exterior of a firearm and the second aperture is to enable air to flow from the exterior of the firearm to the first chamber.

18. The locking system as defined in claim 1, wherein a firearm is a gas pressure loader.

19. The locking system as defined in claim 18, wherein the gas pressure loader comprises a gas rod, a gas piston, and a gas cylinder.

20. The locking system as defined in claim 19, wherein the gas piston is a short gas piston and the cylinder is a short gas cylinder.

21. The locking system as defined in claim 19, wherein the gas rod extends from a gas discharge to the breechblock carrier and wherein the gas rod interacts with the locking system to move the breechblock carrier toward a rear of the firearm to interact with the piston to expel fluid through the first aperture.

22. A locking system for use with a firearm, comprising:

a breechblock carrier;

a lock spring mechanism including a piston, the breechblock carrier being configured to interact with the piston to move the piston as the breechblock carrier retracts to open a breech;

a first aperture, wherein the piston is configured to expel fluid through the first aperture when the breechblock carrier retracts;

a chamber that is fluidly coupled to an exterior of a firearm by the first aperture, wherein when fluid is contained in the chamber, the fluid is to flow from the chamber through the first aperture to the exterior of the firearm; and at least one notch to horizontally adjust a shoulder support relative to the firearm, wherein the first aperture is adjacent one of the at least one notch and wherein the first aperture is radially positioned relative to an axis of the firearm.

23. A locking system for use with a firearm, comprising:

a breechblock carrier;

a lock spring mechanism including a piston, the breechblock carrier being configured to interact with the piston to move the piston as the breechblock carrier retracts to open a breech;

a first aperture, wherein the piston is configured to expel fluid through the first aperture when the breechblock carrier retracts;

a second aperture that is at least partially defined by the breechblock carrier, wherein the second aperture is radially positioned relative to an axis of a firearm;

a chamber that is fluidly coupled to an exterior of a firearm by the second aperture, wherein when fluid is contained in the chamber, the fluid is to flow from the chamber through the second aperture to an exterior of the firearm; and a breechblock adjacent the breechblock carrier, wherein the chamber is at least partially positioned in the breechblock carrier.

24. A locking system for use with a firearm, comprising:

an aperture; and a chamber that is fluidly coupled to an exterior of a firearm by the aperture, wherein when fluid is contained in the chamber, the fluid is to flow from the chamber through the aperture to the exterior of the firearm in response to a component of the firearm being driven by a breechblock carrier relative to the aperture as a breech of the firearm is opened.

25. The locking system as defined in claim 24, wherein the component is at least one of a breechblock carrier or a firing pin.

26. The locking system as defined in claim 24, wherein the component is a piston that interacts with a breechblock carrier.

27. The locking system as defined in claim 24, wherein the aperture is a first aperture and the chamber is a first chamber and wherein the first aperture is positioned adjacent a firing pin.

28. The locking system as defined in claim 27, further comprising a second aperture and a second chamber that is fluidly coupled to the exterior of the firearm by the second aperture, wherein the second chamber is at least partially defined by a spring housing.

* * * * *